US006914253B2

(12) United States Patent
Korenev et al.

(10) Patent No.: US 6,914,253 B2
(45) Date of Patent: Jul. 5, 2005

(54) SYSTEM FOR MEASUREMENT OF ABSORBED DOSES OF ELECTRON BEAMS IN AN IRRADIATED OBJECT

(75) Inventors: Sergey A. Korenev, Mundelein, IL (US); Ivan S. Korenev, Mundelein, IL (US)

(73) Assignee: STERIS Inc., Temecula, CA (US)

( * ) Notice: Subject to any disclaimer, the term of this patent is extended or adjusted under 35 U.S.C. 154(b) by 0 days.

(21) Appl. No.: 10/279,419

(22) Filed: Oct. 24, 2002

(65) Prior Publication Data

US 2004/0079900 A1 Apr. 29, 2004

(51) Int. Cl.[7] ..... G21G 5/00; G21K 1/02; G21V 3/02

(52) U.S. Cl. ..... 250/492.3; 250/363.1; 250/208.1; 250/336.2; 324/370.01; 324/71.3; 324/71.4

(58) Field of Search ..... 250/492.3, 363.1, 250/208.1, 336.2, 455.11, 492.1, 305, 453, 453.11, 454.11

(56) References Cited

U.S. PATENT DOCUMENTS

| | | | | |
|---|---|---|---|---|
| 5,635,714 A | * | 6/1997 | Nablo et al. | 250/305 |
| 5,661,305 A | | 8/1997 | Lawrence et al. | 250/397 |
| 5,771,270 A | * | 6/1998 | Archer | 378/65 |
| 6,183,139 B1 | * | 2/2001 | Solomon et al. | 378/137 |
| 6,429,444 B1 | | 8/2002 | Korenev et al. | 250/492.3 |
| 6,459,089 B1 | | 10/2002 | Masefield et al. | 250/453.11 |
| 6,463,123 B1 | | 10/2002 | Korenev | 378/69 |
| 6,476,397 B1 | * | 11/2002 | Francke | 250/385.1 |
| 6,504,898 B1 | * | 1/2003 | Kotler et al. | 378/64 |
| 6,608,882 B2 | * | 8/2003 | Allen et al. | 378/69 |
| 6,614,037 B2 | * | 9/2003 | Naito | 250/492.3 |

OTHER PUBLICATIONS

McLaughlin et al., "*Dosimetry of Radiation Processing*" Taylor & Francis, New York, NY, 1989, pp. 50–51.

ASTM, E–1649–94, *Standard Practice for Dosimetry in an Electron Beam Facility for Radiation Processing at Energies Between 300 keV and 25 Me.V*[1], American Society of Testing and Materials Standards (ASTM), 1998, pp. 823–841.

Nablo et al., Radiation Phys. Chem., 1995, vol. 46, Nos. 4–6, pp. 1377–1383.

McKeown et al., Impela News, AECL, Electron Beam Newsletter, vol. 2, No. 4, Dec. 1995.

Lawrence et al., Radiation Phys. Chem., 1998, vol. 52, Nos. 1–6, pp. 543–547.

ISO/ASTM, 51431–2002, *Standard Practice for Dosimetry in Electron and bremsstrahlung Irradiation Facilities for Food Processing*, American Society of Testing and Materials Standards (ASTM).

(Continued)

*Primary Examiner*—John R. Lee
*Assistant Examiner*—Kalimah Fernandez
(74) *Attorney, Agent, or Firm*—Kusner & Jaffe; Michael A. Centanni

(57) ABSTRACT

A method and apparatus for measuring doses of electron beams that are absorbed by an object subjected to e-beam irradiation. The absorbed dose can be continuously measured during an irradiation process, and adjustment can be made to system parameters in accordance with the measured absorbed dose.

35 Claims, 8 Drawing Sheets

OTHER PUBLICATIONS

DuSautoy, "*The UK primary standard calorimeter for photon–beam absorbed dose measurement*," Phys. Med. Biol., 41, pp. 137–151, 1996.

Korenev, "*Compact Electron Accelerator for Radiation Technologies*," Proceedings of the 2001 Particle Accelerator Conference, Chicago, IEEE, pp. 2509–2511, 2001.

Korenev et al., "*The Real–Time System Electron Beam Dose Measurements for Industrial Accelerator*.", no date.

U.S. Appl. No. 09/710,475, filed Nov. 9, 2000, Korenev, entitled: System for Electron and X–Ray Irradiation of Product.

U.S. Appl. No. 09/715,481, filed Nov. 17, 2000, Korenev, entitled: On–Line Measurement of Absorbed Electron Beam Dosage in Irradiated Product.

U.S. Appl. No. 10/090,573, filed Mar. 4, 2002, Korenev, entitled: Mobile Radiant Energy Sterilizer.

U.S. Appl. No. 10/095,869, filed Mar. 12, 2002, Korenev et al., entitled: Method and Apparatus for Destroying Microbial Contamination of Mail.

Article entitled: "*Electron beam curing of composites*," Korenev, Vaccuum 62, 2001, pp. 233–236.

Article entitled: "*Distribution of Absorbed Doses in the Materials Irradiated by "Rhodotron" Electron Accelerator: Experiment and Monte Carlo Simulations*," Kolchuzhkin et al., Proceedings of the 2001 Particle Accelerator Conference, Chicago, IEEE, 2001, pp. 2500–2502.

Article entitled: "*Compact Electron Accelerator for Radiation Technologies*," Korenev, Proceedings of the 2001 Particle Accelerator Conference, Chicago, IEEE, 2001, pp. 2509–2511.

Article entitled: "*Measurements of Beam Current for Relativistic Electrons in Air by Current Transformers,*" Korenev, Proceedings of the 2001 Particle Accelerator Conference, Chicago, IEEE, 2001, pp. 2332–2334.

Article entitled: "*Expert System for the Rhodotron Eelctron Accelerator Control*," Popov et al., 1 page.

Korenev et al., "*The Real–Time System Electron Beam Dose Measurements for Industrial Accelerators*," Proceedings of the 2003 Particle Accelerator Conference, IEEE, May 12–16, 2003, pp. 1611–1613, vol. 3.

* cited by examiner

SYSTEM FOR MEASUREMENT OF ABSORBED DOSES OF ELECTRON BEAMS IN AN IRRADIATED OBJECT

FIELD OF THE INVENTION

The present invention relates to electron beam irradiation, and more particularly to a method and apparatus for measuring doses of electron beams that are absorbed by an irradiated object.

BACKGROUND OF THE INVENTION

It is well known to subject an object to electron beam (e-beam) radiation for a variety of beneficial purposes. For instance, e-beam irradiation has been widely used for such purposes including, but not limited to: (a) pharmaceutical sterilization to inactivate microorganisms either by causing microbial death as a direct effect of the destruction of a vital molecule or by an indirect chemical reaction, (b) food irradiation to target bacteria DNA, thus destroying the ability of the bacteria to reproduce or live, (c) cross-linking and molecular modification of polymeric products (e.g., wire, cable and tubing) to improve characteristics of the polymer, (d) polymer chain scission to improve properties of certain polymers by creating controlled degradation, (e) curing of adhesives and resins, and (f) treating semiconductors to control semiconductor switching speeds. Recently, e-beam radiation has found use in the efforts to protect against bioterrorism. In this regard, mail has been irradiated to neutralize any contaminants located therein.

In order to effectively monitor e-beam irradiation, and verify that an object has received appropriate exposure to the e-beam radiation, it is necessary to determine the "absorbed dose" of electron beams that are absorbed by that object. "Absorbed dose" refers to the energy imparted by ionizing radiation per unit mass of an irradiated material. Absorbed dose is commonly defined in units of J/kg, Grays, or Rads.

The present invention provides a method and apparatus for accurately measuring doses of electron beams that are absorbed by an irradiated object.

SUMMARY OF THE INVENTION

In accordance with the present invention, there is provided an irradiation apparatus, comprising: (a) an e-beam source for providing an e-beam; (b) a conveyor system for conveying an object to be irradiated through the e-beam at a speed v, said conveyor system including an opening that allows a portion of the e-beam to pass through the object without striking the conveyor system; (c) a collimator locatable to isolate portions of the e-beam that have passed through the opening, said collimator including at least first and second apertures for respectively providing first and second collimated e-beams; and (d) first and second sensors for providing data indicative of the kinetic energy of the electrons absorbed by the object, said first sensor receiving the first collimated e-beam, and the second aperture receiving the second collimated e-beam.

In accordance with another aspect of the present invention, there is provided a method for irradiating an object, comprising the steps of: (a) accelerating electrons to provide an e-beam; (b) moving an object through the e-beam on a conveyor system, said object traveling at a speed v; (c) measuring a first current and a second current indicative of a kinetic energy absorbed by the object passing through the e-beam; and (d) determining an absorbed dose D for a selected area of the object in accordance with the kinetic energy absorbed by the object passing through the e-beam.

In accordance with yet another aspect of the present invention, there is provided an irradiation system, comprising: (a) radiation generating means for generating an e-beam of known energy; (b) conveyance means for conveying an object through said e-beam at a speed v; (c) sensing means for providing data indicative of a kinetic energy absorbed by the object; and (d) processing means for receiving said data and determining a value for absorbed dose D of the object.

It is an advantage of the present invention to provide a method and apparatus that improves the accuracy for measuring a dose of electron beams absorbed by an object subject to irradiation.

Another advantage of the present invention is to provide a method and apparatus for measuring absorbed doses of electron beams that shields components, to prevent overheating due to heat generated by the electron beam and radiation resistance of components, such as sensors and cables.

Yet another advantage of the present invention is to provide a method and apparatus for measuring absorbed doses of electron beams that compensates for the complex dynamics (i.e., current density) of an electron beam in air.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF A PREFERRED EMBODIMENT

Figure 1:
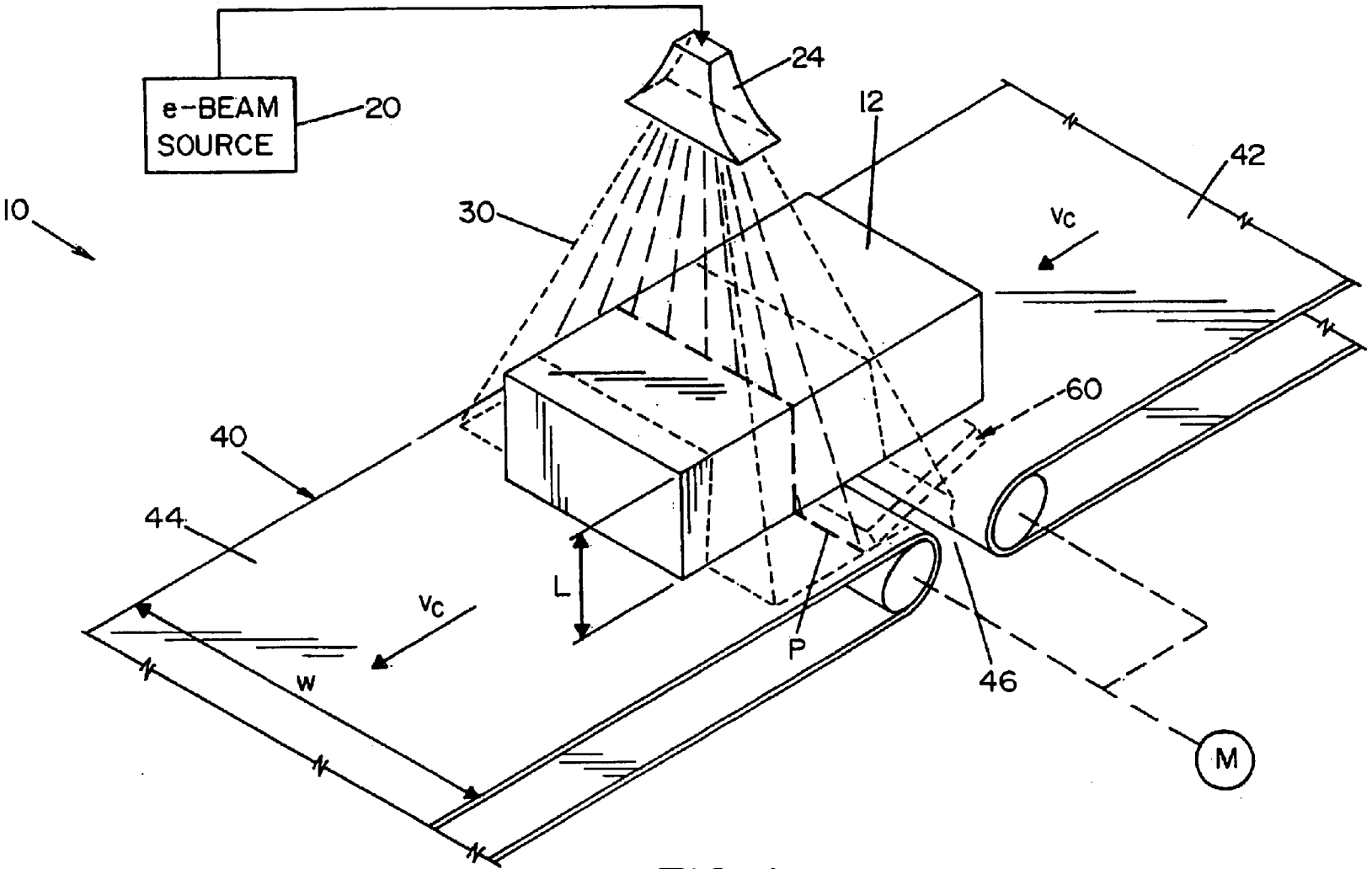
FIG. 1 is a perspective view of an e-beam irradiation apparatus including an apparatus for determining an absorbed dose of an electron beam, according to a preferred embodiment of the present invention.

Referring now to the drawings wherein the showings are for the purpose of illustrating the preferred embodiment of the invention only, and not for the purpose of limiting same, FIG. 1 shows an e-beam irradiation system 10, according to a preferred embodiment of the present invention. Electron beam (e-beam) irradiation system 10 includes an e-beam source 20, a conveyor system 40, a collimator 60, first and second sensors 80A, 80B (see FIG. 3), and a processing system 120 (see FIG. 9A).

Basically, e-beam source 20 provides an e-beam 30 for irradiating an object, while conveyor system 40 moves the object through the e-beam. Collimator 60 isolates portions of the e-beam that has passed through the object. The isolated portions are received by sensors 80A, and 80B. Sensors 80A and 80B are used to provide an indication of the kinetic energy of the electrons of the e-beam after the e-beam has passed through the object. Based upon data provided by sensors 80A, 80B and other parameter data, processing system 120 determines a value for "absorbed dose." Processing system 120 may also control and monitor operation of e-beam irradiation system 10.

E-beam source 20 includes a source of electrons, and an electron accelerator that accelerates the electrons to form an e-beam 30 having a preselected energy and beam current. E-beam 30 is output through a horn 24, as best seen in FIG. 1. The preselected energy values of e-beam 30 are typically in the range of 0.2 MeV to 20 MeV, and preferably about 1 MeV to 10 MeV. The accelerator may provide a pulsed, direct current (DC), radio frequency continuous wave (RF CW), or radio frequency (RF) pulsed e-beam. Examples of suitable electron accelerators include, but are not limited to, Rhodotron™ and Dynamitron™ electron accelerators, manufactured by IBA (Belgium). The beam current of e-beam 30 will depend upon the type of electron accelerator used. Beam currents may range from 1 mA to 1 MA, depending upon the accelerator type. In the case of a pulsed accelerator, the beam current will typically be in the range of 1 A to $10^6$ A. In contrast, the beam current will typically be in the range of 0.1 mA to 150 mA for CW, LINAC (linear accelerator) and direct current (DC) accelerators. In a preferred embodiment, the distance between horn 24 and conveyor system 40 is about 70 to 80 cm.

Figure 2:
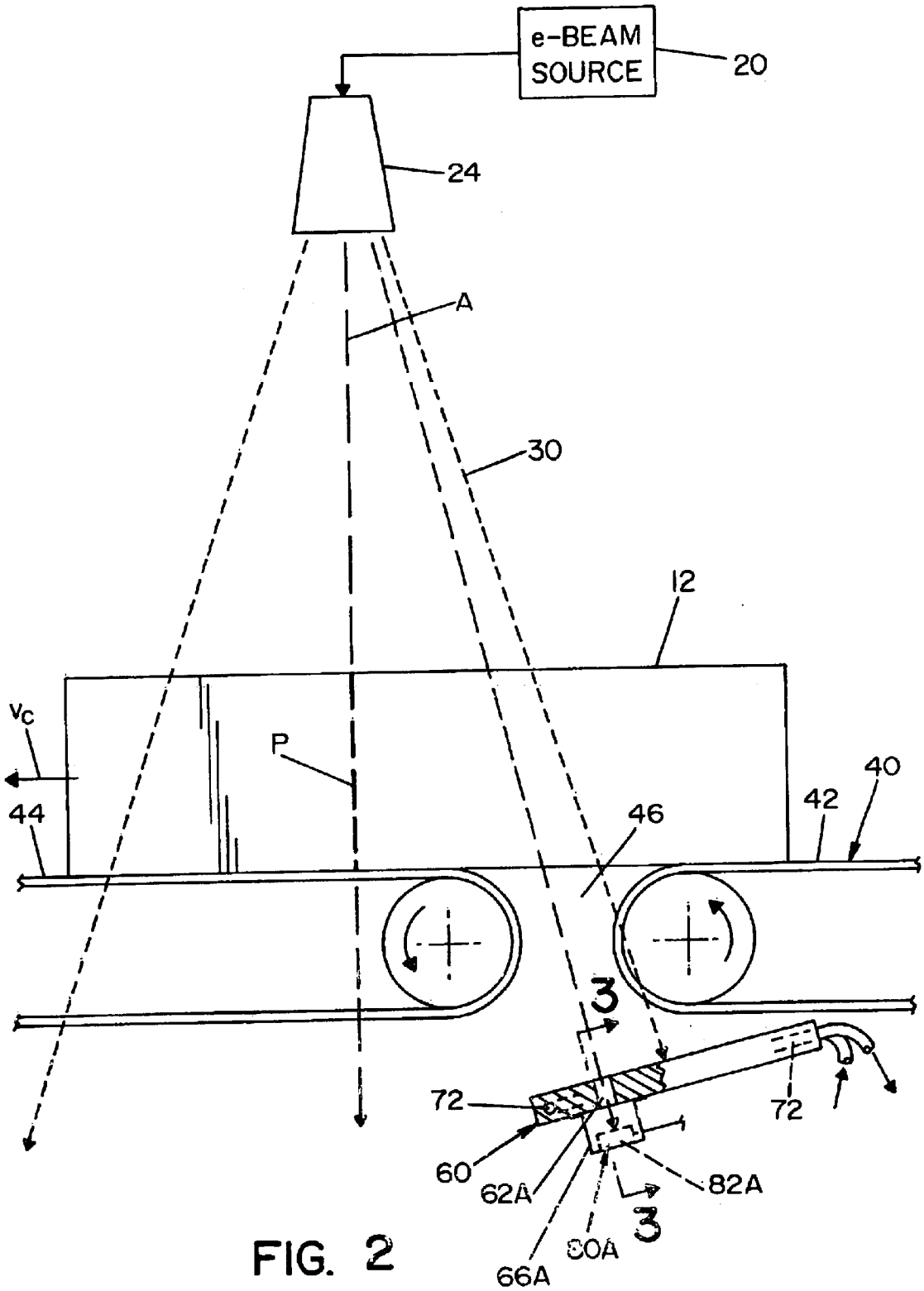
FIG. 2 is a side view partially in section of the system shown in FIG. 1.

E-beam source 20 may also include a scanning control (not shown) to scan e-beam 30 back and forth in a selected plane across conveyor 40 at a repetition frequency (e.g., 100 Hz). Horn 24 focuses e-beam 30 towards conveyor system 40. As e-beam 30 leaves horn 24, e-beam 30 has a 1–6 cm diameter ray. E-beam 30 expands outwardly the further the beam extends from horn 24. In other words, the diameter of e-beam 30 increases in air as the distance from horn 24 increases, wherein e-beam 30 assumes a conical shape that is symmetrical about a central beam axis "A," as best seen in FIG. 2. This conical shape results from complex interaction of the electrons from e-beam 30 with air plasma.

As will be appreciated by those skilled in the art, the current density of e-beam 30 decreases, as the cross-section of e-beam 30 increases. E-beam 30 is rapidly scanned back and forth along scanning path P (see FIG. 1), in a direction perpendicular to the direction of travel of object 12 (reference arrow $v_c$ indicating the direction of travel of object 12). E-beam 30 scanning may be performed in a plurality of modes, namely (1) perpendicular, (2) parallel, or (3) any angle in between, relative to the direction of the moving object (i.e. direction of conveyance). In a preferred embodiment the scanning angle is an arc of about 15° to either side of the center of conveyor 40 (i.e., a total arc of about 30°). It should be appreciated that the dimensions of e-beam 30 are not shown to scale, but are shown solely to illustrate a preferred embodiment of the present invention.

It should be understood that e-beam 30 can be swept in other dimensions. For example, the beam can also be swept parallel to the direction of motion of conveyor system 40, or in two directions, to travel a large rectangular swath. It is contemplated that the present invention is adaptable to these alternative scanning paths as would be readily appreciated by one of ordinary skill in the art.

Conveyor system 40 conveys object 12 through e-beam 30. In a preferred embodiment, conveyor system 40 includes first and second belt conveyors 42 and 44. Belt conveyors 42, 44 preferably have a width "w" in a range of 80 to 100 cm. A gap 46 is provided between belt conveyors 42, 44 to provide an open path for e-beam 30 passing through object 12 to reach sensors 80A, 80B, which are described in detail below. In a preferred embodiment, gap 46 is about 1 to 10 cm wide, preferably 4 to 7 cm wide, and more preferably 5 to 6 cm wide. Each belt conveyor 42, 44 is driven by one or more motors M, as schematically illustrated in FIG. 1. A motor speed controller 130 (see FIG. 9A) controls the speed of the conveyor motors M, and in turn, the speed at which object 12 passes through e-beam 30. In a preferred embodiment, object 12 is conveyed through e-beam 30 by conveyor system 40 at a speed in the range of 0.1 to 50 cm/sec, preferably 0.1 to 35 cm/sec, and more preferably 1 to 15 cm/s.

Figure 3:
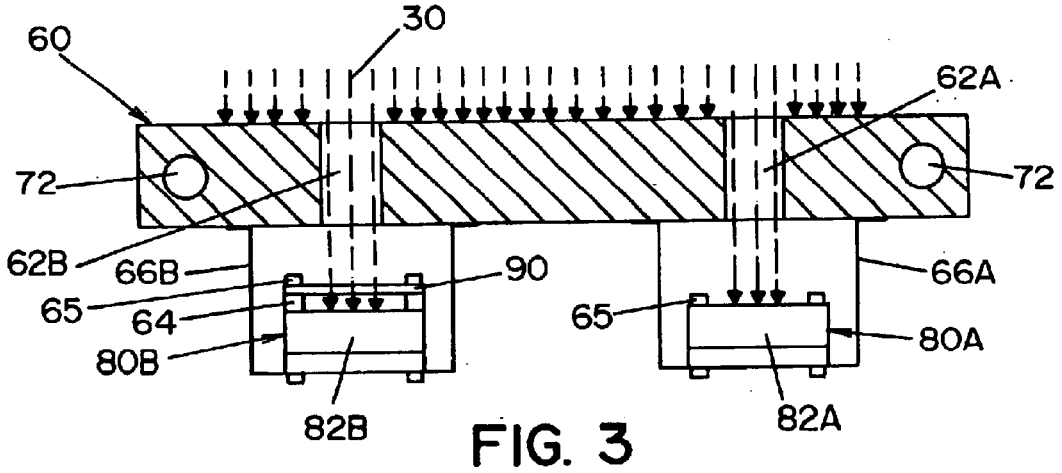
FIG. 3 is a cross-sectional view taken along line 3—3 of FIG. 2, showing a collimator and first and second sensors of the apparatus for determining an absorbed dose, according to a preferred embodiment of the present invention.
Figure 4:
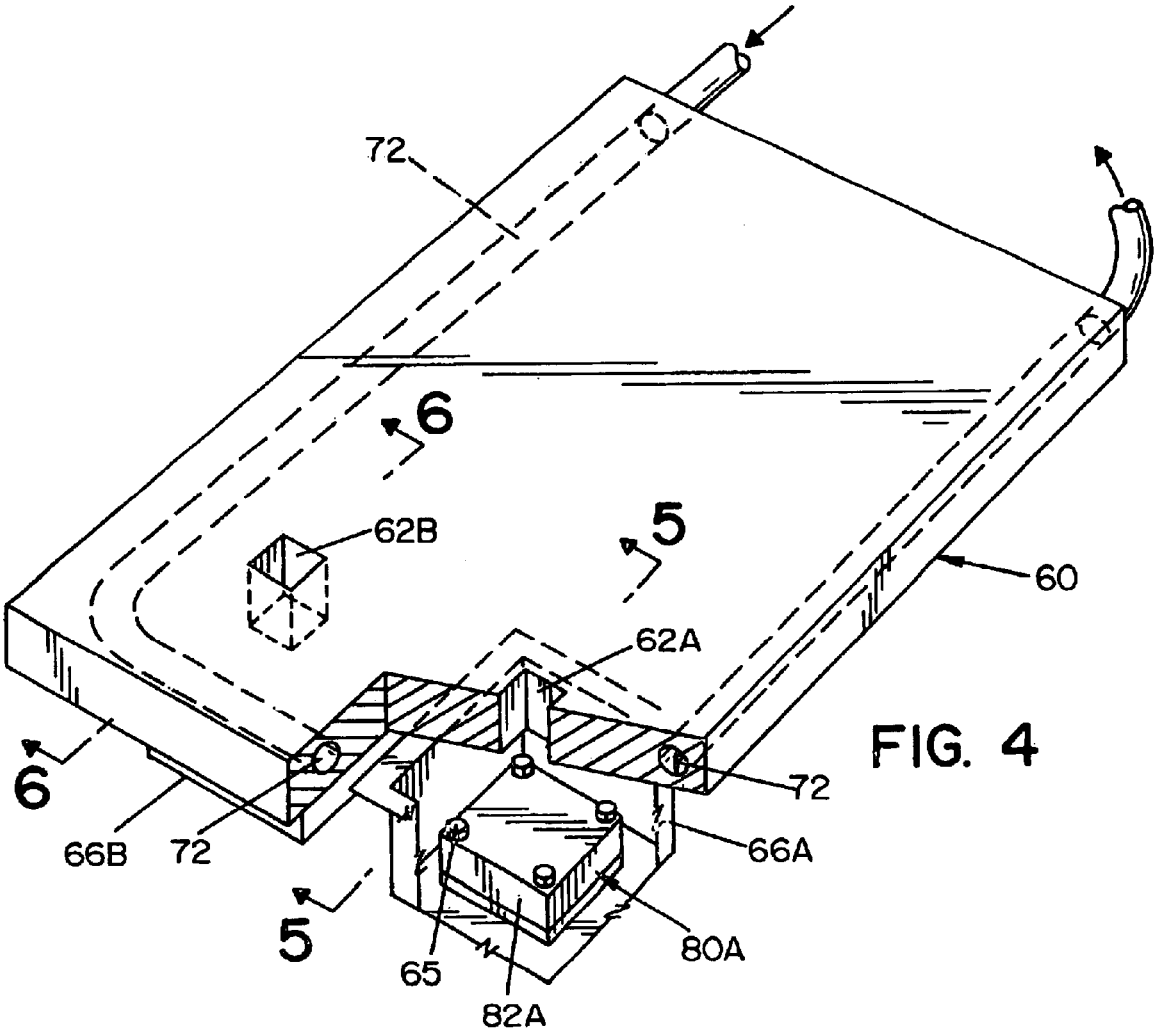
FIG. 4 is a partially sectioned, perspective view of the collimator shown in FIGS. 2 and 3.

Referring now to FIGS. 2–4, collimator 60 is located on the side of belt conveyors 42, 44 opposite e-beam source 20. Collimator 60 is preferably a generally planar structure. In the embodiment shown, collimator 60 is a metal plate having first and second apertures 62A and 62B formed therein. Collimator 60 is positioned relative to the axis of e-beam 30 so as not to be in line with the high intensity portion of e-beam 30.

Apertures 62A, 62B may take any suitable geometric form (e.g., square, rectangle, circle, etc.). In a preferred embodiment, each aperture 62A, 62B is a square opening having a width and length of about 1 cm. Apertures 62A and 62B are dimensioned and aligned with gap 46 so as to receive "like" portions of e-beam 30 passing through object 12 and gap 46. It should be appreciated that in a preferred embodiment, the portions of e-beam 30 that are isolated by apertures 62A, 62B are not those portions of e-beam 30 along axis A. In this regard, the portion of e-beam 30 along axis A has high intensity electrons, and thus generates significant heat. Isolation of portions of e-beam 30 away from axis A minimizes heating of sensors 80A, 80B.

Collimator 60 is also equipped with a cooling system to cool collimator 60. In this regard, collimator 60 is subject to heating caused by e-beam 30 striking collimator 60, as will be explained further below. In a preferred embodiment, the cooling system comprises cooling tubes 72 that circulate a coolant (e.g., water) to effect cooling of collimator 60, as best seen in FIG. 4.

It should be appreciated that collimator 60 has sufficient thickness to function as a radiation shield, thus protecting the components of sensors 80A, 80B and associated cables from the effects of radiation. Accordingly, sensors 80A, 80B and associated cables can be used for long periods of time without degradation due to radiation exposure. In a preferred embodiment, collimator 60 is dimensioned such that sensors 80A, 80B and associated cables receive an absorbed dose D of about zero.

Housings 66A and 66B (FIG. 3) are provided to secure sensors 80A and 80B to collimator 60. In this regard, sensors 80A, 80B are respectively positioned to receive the like portions of e-beam 30 passing through apertures 62A and 62B, as will be described more fully below. Sensors 80A and 80B are respectively secured to housings 66A and 66B by fasteners 65 (e.g., bolts) made of a dielectric material.

Figure 5:
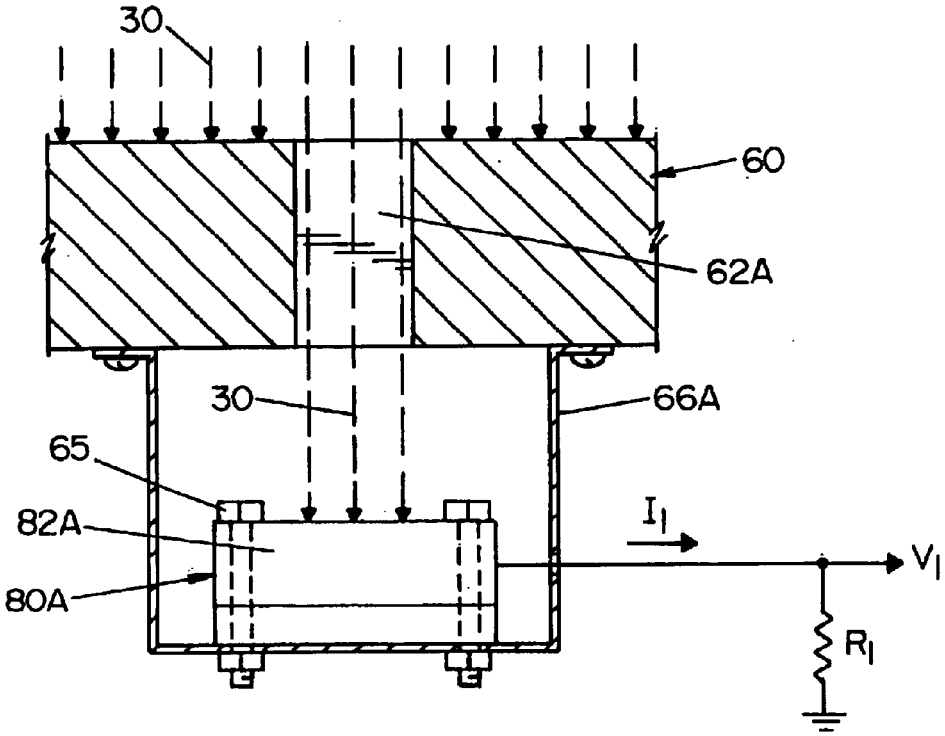
FIG. 5 is a cross-sectional view taken along line 5—5 of FIG. 4, showing the collimator and the first sensor.

With reference to FIG. 5, in a preferred embodiment, sensor 80A is generally comprised of an electron collecting device in the form of Faraday cup 82A. Sensor 80A is positioned to receive a portion of e-beam 30, that has been isolated by aperture 62A, subsequent to passing through object 12 and gap 46. As will be readily appreciated by those skilled in the art, a Faraday cup is an electron collecting device suitable for measuring current. The current $I_1$ associated with the electrons collected by Faraday cup 82A is determined by measuring voltage $V_1$ across resistor $R_1$ (see FIG. 5). Current $I_1$ is the current associated with the portion of e-beam 30 passing through aperture 62A.

Figure 6:
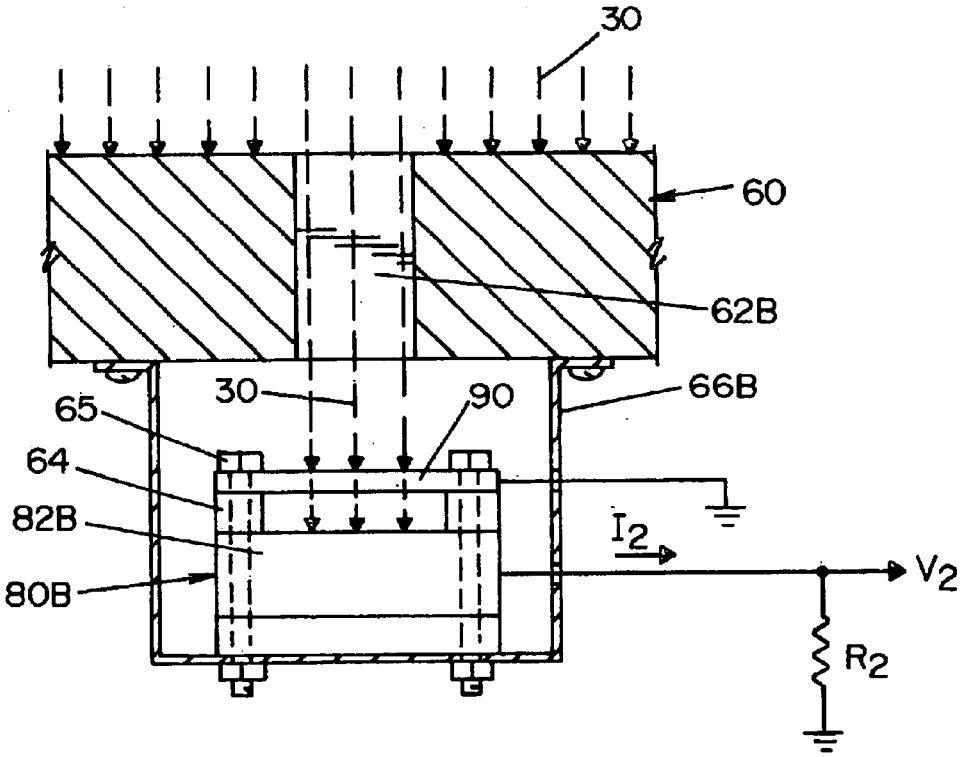
FIG. 6 is a cross-sectional view taken along line 6—6 of FIG. 4, showing the collimator and the second sensor.

With reference to FIG. 6, in a preferred embodiment sensor 80B is generally comprised of an electron collecting device in the form of Faraday cup 82B, and an absorber plate 90. A ring 64 separates absorber plate 90 from Faraday cup 82B. Ring 64 is preferably made of a dielectric material. Absorber plate 90 is positioned in line with that portion of e-beam 30 that has been isolated by aperture 62B, subsequent to passing through object 12 and gap 46. Faraday cup 82B is positioned to receive e-beam 30 after it has passed through absorber plate 90. The current $I_2$ associated with the electrons collected by Faraday cup 82B is determined by measuring voltage $V_2$ across resistor $R_2$. Current $I_2$ is the current associated with the portion of e-beam 30 after it has passed through object 12, gap 46, aperture 62B, and absorber plate 90.

It should be appreciated that sensors 80A and 80B operate in air, at standard pressure, rather than in a vacuum. Consequently, the air molecules have a small effect on the flux of e-beam 30. In this regard, the air molecules diminish e-beam flux.

In a preferred embodiment, absorber plate 90 is connected to ground. Empirical data determined for absorber plate 90 is used to determine the kinetic energy (KE2) of the electrons after passing through object 12. In this regard, empirical data are determined for absorber plate 90 which relate the ratio of $I_2/I_1$ to the kinetic energy of e-beam 30, where $I_2$ is the e-beam current after striking absorber plate 90, and $I_1$ is the e-beam current before the e-beam strikes absorber plate 90. These empirical data are preferably pre-stored in a storage device of processing system 120. As indicate above, the value for $I_2$ is determined from $V_2$ using Faraday cup 82B, while the value for $I_1$ is determined from $V_1$ using Faraday cup 82A.

Figure 7:
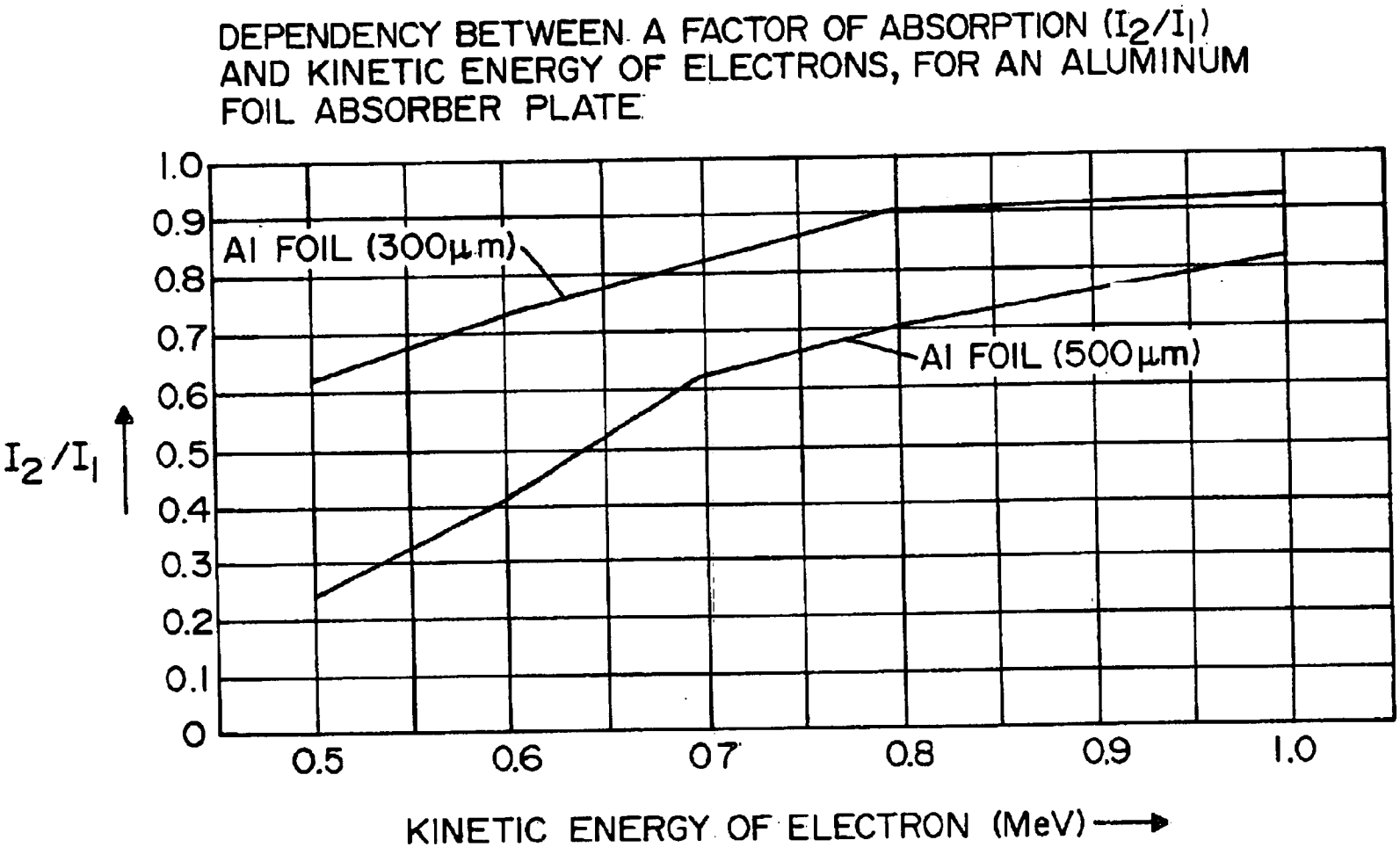
FIG. 7 is a graph showing the dependency between a factor of absorption ($I_2/I_1$) and kinetic energy of electrons, for an aluminum foil absorber plate.
Figure 8:
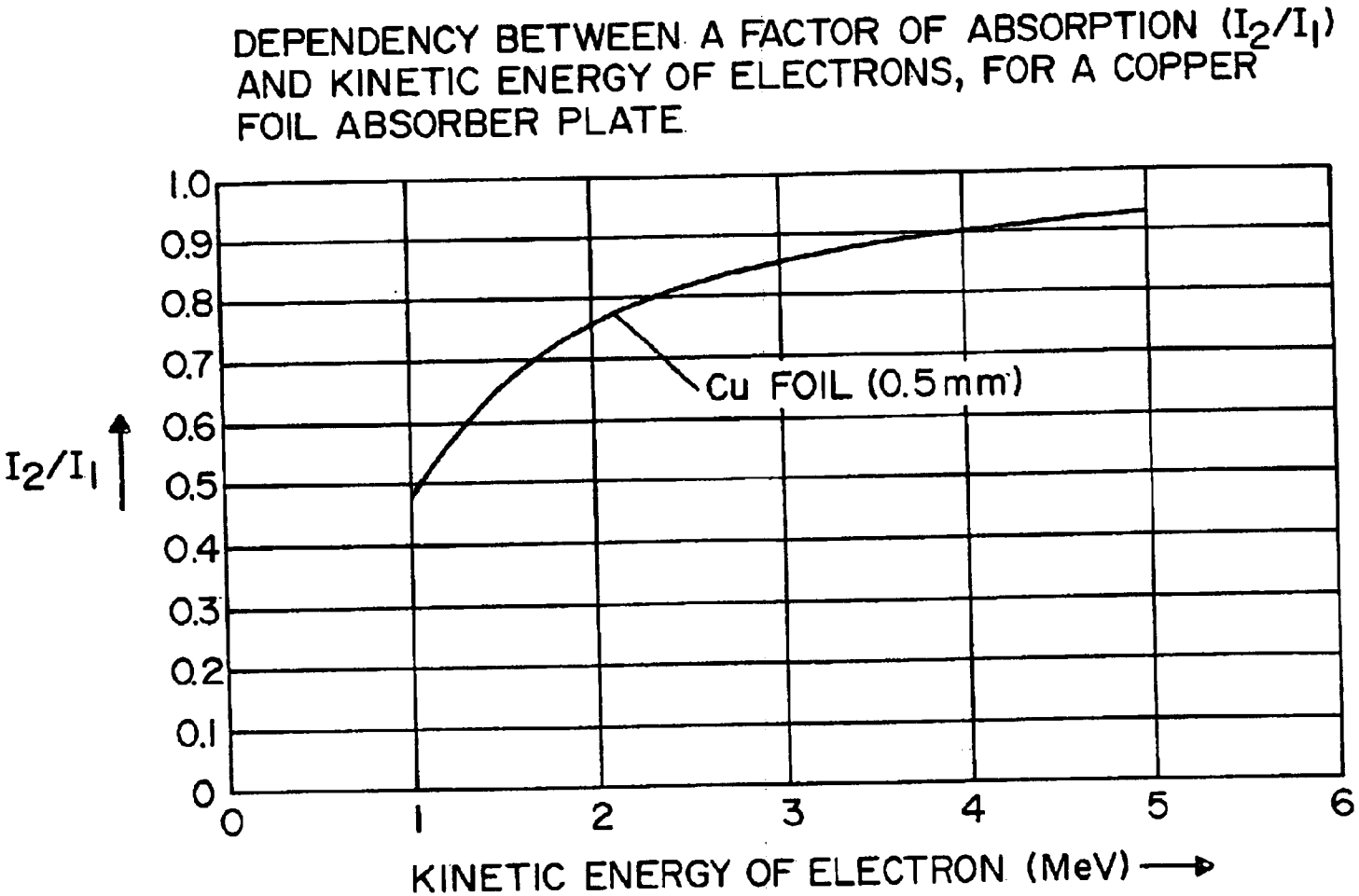
FIG. 8 is a graph showing the dependency between a factor of absorption ($I_2/I_1$) and kinetic energy of electrons, for a copper foil absorber plate.

Referring now to FIGS. 7 and 8, there is shown a graph of empirical data for exemplary absorber plates 90. In FIG. 7, the relationship between $I_2/I_1$ to kinetic energy (MeV) is shown for an aluminum foil having a density of 2.7 g/cm$^3$ and a thickness of 300 $\mu$m, and an aluminum foil having a density of 2.7 g/cm$^3$ and a thickness of 500 $\mu$m. In FIG. 8, the same relationship is shown for a copper foil having a density of 8.9 g/cm$^3$ and a thickness of 0.5 mm.

A positioning system (not shown) is used to adjust the position of collimator 60 relative to central axis A and the path thereof. Collimator 60 is positioned to align apertures 62A and 62B with electrons passing through gap 46.

Operation of irradiation system 10 can be summarized as follows. An object 12 (e.g., a package) is moved through e-beam 30 by conveyor system 40. The kinetic energy of e-beam 30, before it strikes object 12, is known. The energy may be established by the energy parameter of the e-beam accelerator or by a calibration (sensing) device inserted into e-beam 30. Conveyor system 40 is operable to move object 12 at a constant known velocity. As object 12 moves across gap 46 between belt conveyors 42 and 44, it intersects e-beam 30 as e-beam 30 repeatedly scans back and forth across belt conveyors 42 and 44. Sensors 80A and 80B are used to determine the kinetic energy absorbed by object 12 during exposure to e-beam 30.

It should be appreciated that apertures 62A and 62B isolate "like" portions of e-beam 30 that have previously passed through object 12 and gap 46, to provide like "collimated" e-beams. The portion of e-beam 30 isolated by aperture 62A is received by Faraday Cup 82A of sensor 80A. Similarly, the portion of e-beam 30 isolated by aperture 62B is passed through absorber plate 90, and then received by Faraday Cup 82B of sensor 80B. Accordingly, Faraday Cup 82A is used to determine a current associated with the collimated e-beam before passing through absorber plate 90, while Faraday Cup 82B is used to determine a current associated with the collimated e-beam after passing through absorber plate 90.

As indicated above, collimator 60 shields sensors 80A and 80B, and associated cables for electrical contacts from radiation exposure. In this regard, e-beams not passing through apertures 62A and 62B do not influence measurements provided by sensors 80A and 80B, and do not heat sensors 80A and 80B.

Figure 9A:
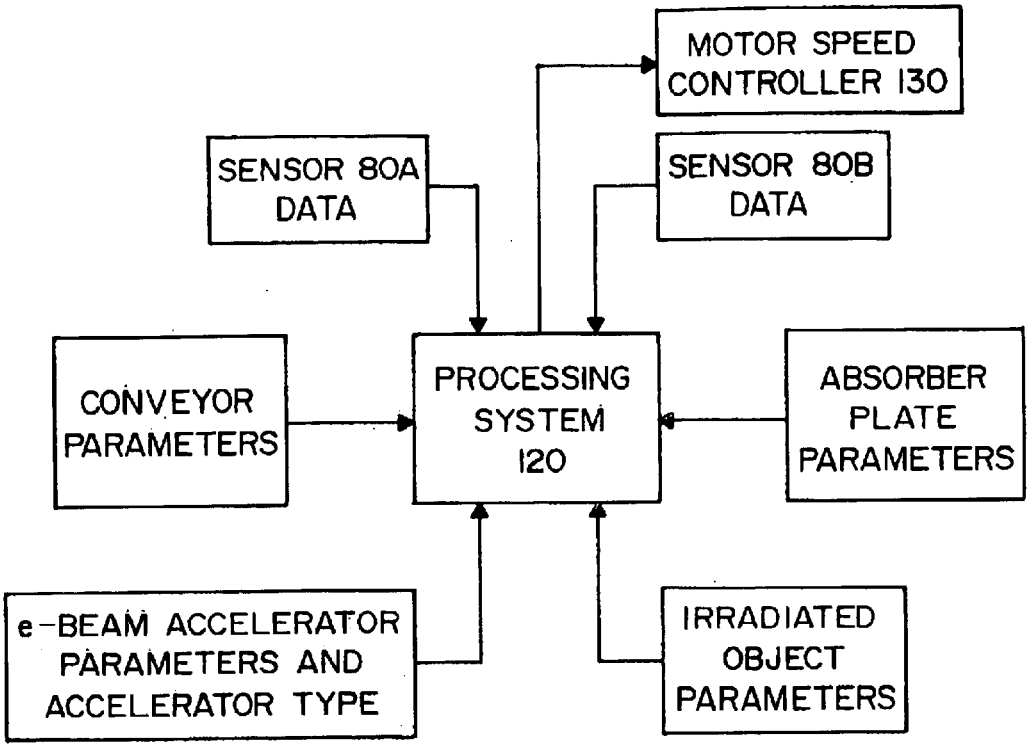
FIG. 9A is a block diagram illustrating the data inputs to a processing system for processing data to determine absorbed doses of an electron beam.

With reference to FIG. 9A, a processing system 120 receives data from sensors 80A and 80B, and using other data (i.e., absorber plate parameters, e-beam accelerator parameters, accelerator type, irradiated object parameters, and conveyor parameters), determines a value for "absorbed dose" D associated with object 12. In a preferred embodiment, processing system 120 takes the form of a conventional personal computer (PC) system, including a processing unit, memory storage devices (e.g., RAM, ROM, hard disk drive, floppy disk drive, and CD-RW), an input unit (e.g., keyboard and mouse), and a data output unit (e.g., monitor and printer).

Figure 9B:
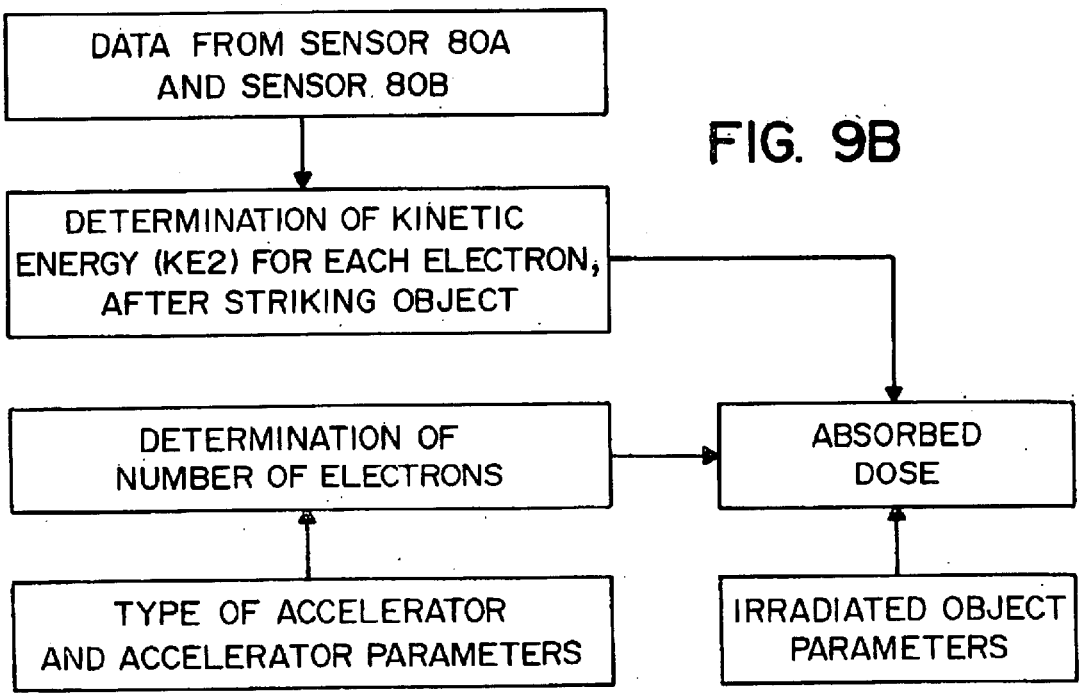
FIG. 9B is a block diagram illustrating an exemplary software algorithm used by the processing system to determine an absorbed dose.

FIG. 9B provides an overview of an algorithm executed by processing system 120 to determine an absorbed dose. Data from sensors 80A and 80B are used to determine the kinetic energy (KE2) for each electron, after striking object 12. In this regard, measured voltages $V_1$ and $V_2$ respectively associated with sensors 80A and 80B are used to calculate values for $I_1$ and $I_2$. The ratio of $I_2$ to $I_1$ is then used to determine a value for kinetic energy KE2 in accordance with the empirically derived relationship illustrated by FIGS. 7 and 8. A more detailed description of the derivation of kinetic energy KE2 is provided below.

Based upon data for the type of accelerator used and other accelerator parameters (e.g., the beam current I of e-beam 30), the number of electrons can be computed for any desired time period. A calculation of an absorbed dose can then be made based upon kinetic energy KE2, the computed number of electrons, the irradiated object parameters (e.g. mass of the object), and the kinetic energy (KE1) of the electrons, as provided by the accelerator.

In this regard, the absorbed dose D associated with an object moving through electron beam 30 is determined in accordance with the following equation:

$$D = \frac{(KE1 - KE2)(I)(T)}{m} = \frac{(\Delta KE)(\text{no. of coulombs})(6.24\times10^{18}\ \text{electrons per coulomb})(1.602\times10^{-19}\,J/\text{eV})}{m}$$

where D is the absorbed dose,

KE1 is the kinetic energy of the electrons before passing through object 12, KE2 is the kinetic energy of the electrons after passing through object 12, I is the e-beam current of e-beam 30, as supplied by e-beam source 20, m is a unit mass of irradiated object 12 (the term "unit mass" referring herein to a preselected mass of object 12 corresponding to a preselected area of object 12), and T is the total beam exposure time of unit mass m to e-beam 30 (i.e., time of irradiation of unit mass m).

A first step in determining "absorbed dose" D is to determine the change in kinetic energy (ΔKE) of an electron passing through object 12. The initial kinetic energy (KE1) of the electrons (i.e., the kinetic energy of the electrons before passing through object 12) is obtained from the energy parameter of the accelerator that accelerates the electrons, or alternatively, using a sensing device for calibrating and verifying the kinetic energy (KE1) of the electrons exiting horn 24.

In accordance with a preferred embodiment of the present invention, the kinetic energy (KE2) of the electrons after passing through object 12 is determined empirically. As will be appreciated by one of ordinary skill in the art, based upon known absorption characteristics of an absorber material (e.g. a metal foil) a relationship can be derived between an electron beam current ($I_1$) before an e-beam strikes the absorber material, an electron beam current ($I_2$) after the e-beam strikes the absorber material, and the kinetic energy of the electrons of the e-beam. More specifically, the kinetic energy of the electrons can be empirically derived from the ratio of $I_2$ to $I_1$. The absorption characteristics are influenced by the thickness, density, and mass of the absorber material. Examples of this empirically derived relationship are respectively illustrated in FIGS. 7 and 8 for aluminum foil and copper foil absorbers.

In accordance with a preferred embodiment of the present invention, lookup tables of absorbed dose values are prestored in processing system 120. The calculated absorbed dose is compared with the pre-stored absorbed dose values. The processing system may be pre-programmed to take one or more actions in response to the result of the comparison. For instance, one or more system parameters (including but not limited to, conveyor speed, e-beam current, e-beam energy, beam scan velocity, and the like) may be modified to ensure that a sufficient dose of electron beam irradiation is absorbed by object 12. In addition, processing system 120 may provide a human-readable data display using a data output unit, and store archival data in memory.

Set forth below is a table providing a definition of symbols used herein to describe computation of absorbed dose D, according to a preferred embodiment of the present invention.

| SYMBOL | DEFINITION |
|---|---|
| m | Unit mass of object |
| ρ | Density of object |
| V | Volume of object |
| A | Unit area of object |
| L | Thickness of unit mass object |
| $v_s$ | Beam scanning velocity |
| $l_s$ | Beam scanning length |
| $t_s$ | Beam scanning period |
| f | Beam scanning frequency |
| Y | Length of unit area A in direction of conveyance |
| X | Length of unit area A in direction of beam scanning |
| $v_c$ | Conveyor speed |
| $t_c$ | Exposure time for unit area A per beam scan |
| $T_t$ | Travel time for unit area A through beam |
| $N_s$ | Total number of beam scans during travel time $T_t$ |
| T | Total Beam exposure time |

Unit mass m of irradiated object 12 is determined for a selected a unit area A of object 12 by computing the product of (a) the volume V corresponding to the selected unit area A, and (b) the density ρ of object 12. In a preferred embodiment it is presumed that object 12 has a generally uniform density. It should be appreciated that the unit area may be any selected geometry. However, for the purpose of simplifying calculations a square or rectangular geometry is preferred.

Furthermore, while the entire area of object 12 could be selected as unit area A to determine an absorbed dose D based upon the entire mass of object 12, it is preferable to select a relatively small area of object 12 so that modifications can be made to system parameters during irradiation of object 12. In this regard, absorbed dose D can be continuously monitored as object 12 is moved through e-beam 30, and appropriate adjustments to system parameters can be made. For instance, the measured absorbed dose D can be continuously compared to a threshold value during irradiation, and modifications can be made to one or more system parameters to effect an increase or decrease in the measured absorbed dose D.

Total beam exposure time T of unit mass m is determined by using: (1) the known values of the e-beam scanning parameters, i.e., e-beam scanning period $t_s$ (or scanning frequency $f=1/t_s$), and e-beam scanning length $l_s$ (per scanning period); (2) the dimensions of the selected unit area A corresponding to unit mass m; and (3) conveyor speed $v_c$.

Scanning period $t_s$ is typically computed from the scanning frequency f, where $t_s=1/f$. Using the scanning period $t_s$, and the beam scanning length $l_s$, the beam scanning velocity $v_s$ is computed, where $v_s=(2)(l_s)/t_s$. It should be appreciated that the beam scanning length is multiplied by 2 (as above), since the e-beam scans across the beam scanning length $l_s$ twice in a single scanning period $t_s$.

Beam scanning length $l_s$ is measured as the sum of the distances of (1) the center axis to a first edge (corresponding to a maximum beam position to one side of the center axis), (2) the first edge to the center axis, (3) the center axis to a second edge (corresponding to a maximum beam position to the other side of the center axis), and (4) the second edge to the center axis.

Using the beam scanning velocity $v_s$ and the length X of the unit area in the scanning direction of the e-beam, the exposure time (i.e., $t_{se}$) for the unit area A, per beam scan, is computed, where $t_{se}=X/v_s$. Therefore, the total number of electrons ($N_{et}$) in e-beam 30, per each beam scan, can be determined from the product of (1) the beam current I (coulombs/sec) and (2) the exposure time $t_{se}$, divided by the elementary charge of an electron (e). Thus, $$N_{et}=(I)(t_s)/(e)=(I)(t_{se})/(1.6\times10^{-19}\text{ coulomb}).$$

The travel time $T_t$ through the e-beam for unit area A is computed using length y of the unit area in the direction of conveyance, and conveyor speed $v_c$, where $T_t=T/v_c$.

For the travel time $T_t$, the total number of beam scans $N_s=(T_t)(f)$ is computed. Thus, the total beam exposure time T for unit area A is the product of (1) the total number of beam scans $N_s$, and (2) the exposure time $t_{se}$ per each beam scan (i.e., $T=(N_s)(t_{se})$).

Therefore, the total number of electrons ($N_{eT}$) for the total beam exposure time (T), can be determined from the product of (1) the beam current I (coulombs/sec) and (2) the total beam exposure time T, divided by the elementary charge of an electron (e). Thus, $$N_{eT}=(I)(T)/(e)=(I)(T)/(1.6\times10^{-19}\text{ coulomb}).$$

It should be understood that in accordance with a preferred embodiment, the calculations for determining total beam exposure time T is based upon the following assumptions/approximations. First, it is assumed that the e-beam is basically a point which traces a line as it scans. In addition, it is assumed that unit area A receives the full output of e-beam 30 during total beam exposure time T.

As indicated above, kinetic energy KE1 and beam current I are parameters of the selected type of accelerator used to generate e-beam 30. Typically, KE1 is in the range of 0.2 MeV to 20 MeV (preferably 1 MeV to 10 MeV). Beam current I may range from 1 mA to 1 MA, depending upon the selected type of electron accelerator, as discussed above. As will be readily appreciated by those skilled in the art, once a value for beam current I is known, the number of electrons for any desired time period (e.g., $t_{se}$ and T) can be readily determined, since there are approximately $6.24\times10^{18}$ electrons per coulomb.

Kinetic energy KE1 and beam current I of e-beam 30 (as output from horn 24) may be calibrated and verified using the apparatus of the present invention, but without the presence of object 12 on conveyer system 40. In this regard, measured kinetic energy KE2 should approximately equal KE1, since there is no object 12 to absorb kinetic energy. Similarly, current I can be determined by measuring the current $I_1$ associated with sensor 80A. Measured current $I_1$ should approximately equal current I in the absence of object 12.

As also discussed above, KE2 is determined empirically. In this regard, a relationship between (1) the ratio of: (a) the measured e-beam current $I_2$ after striking an absorber plate and (b) the measured e-beam current $I_1$ before striking the absorber plate, and (2) the kinetic energy KE2 is empirically derived.

Acceptable absorbed dose values for some common applications are listed in the table below:

| Application | Absorbed Dose |
|---|---|
| Bacteria control | 1.5–3.0 kGray |
| Crosslinking | 50–150 kGray |

-continued

| Application | Absorbed Dose |
|---|---|
| Degradation | 500–1500 kGray |
| Delay ripening | 0.5–1.0 kGray |
| Fungi control | 1.5–3.0 kGray |
| Grafting | 25–50 kGray |
| Insect disinfestation | 0.3–0.5 kGray |
| Parasite control | 0.3–0.5 kGray |
| Polymerization | 25–200 kGray |
| Sprout inhibition | 0.1–0.2 kGray |
| Sterilization | 15–30 kGray |

The present invention will now be further described by way of the following example:

EXAMPLE 1

| Electron Beam Parameters | |
|---|---|
| Accelerator Type | "Rhodotron" RF CW |
| KE of emitted electrons (KE1) | 5 MeV |
| Beam Current (I) | 10 mA |
| Beam Repetition Rate (f) | 100 Hz (scans/sec) |
| Beam Scanning Length ($l_s$) | 200 cm |

| Irradiated Object Parameters | |
|---|---|
| Unit Area (A) | 1 $cm^2$ |
| Geometry of Unit Area | Square |
| Length X | 1 cm |
| Length Y | 1 cm |
| Thickness (L) | 2 cm |
| Density (ρ) | 3 $g/cm^3$ |

| Conveyor Parameters | |
|---|---|
| Conveyor Speed ($v_c$) | 1 cm/sec |

| Sensor 80A Parameters | |
|---|---|
| Resistor $R_1$ | 100 Ohms |
| Measured $V_1$ | 0.7 Volts |

| Sensor 80B Parameters | |
|---|---|
| Absorber Material | Aluminum |
| Density | 2.7 $g/cm^3$ |
| Thickness | 500 μm |
| Resistor $R_2$ | 100 Ohm |
| Measured $V_2$ | 0.44 Volts |

Computed Values

Unit mass $m = (\rho)(V) = (\rho)(A)(L) = (3\ \text{g/cm}^2)(1\ \text{cm}^2)(2\ \text{cm}) = 6\text{g}$ Beam scanning velocity $v_s = (2)(I_s)/t = (2)(I_s)(1/f)$ $= (2)(200\ \text{cm})/(0.01\ \text{sec}) = 4\times10^4\ \text{cm/s}$ Exposure time per beam scan $t_{sc} = X/v_s = 1\ \text{cm}/(4\times10^4\ \text{cm/s}) = 25\ \mu\text{sec}$ Travel time through beam $T_t$ = (length $Y$)/(conveyer speed $v_c$) = 1 cm/(1 cm/s)

= 1 sec

For the travel time $T_t$, the total number of beam scans $N_s = (T_t)(f)$

= (1 sec)(100 Hz)

= 100 scans

Total beam exposure time $T$ (for unit area $A$) = $(N_s)(t_{sc})$

= (100 scans)(25 $\mu$sec per scan)

$= 2.5\times10^{-3}$ sec

= 2.5 msec of exposure time $I_1 = V_1/R_1 = 0.7V/100\,\Omega$ $I_2 = V_2/R_2 = 0.44V/100\,\Omega$ $I_2/I_1 = 0.44/0.7 = .6286$ KE2=0.7 MeV per electron, as derived from the table of FIG. 7, using $I_2/I_1$ for 500 $\mu$m aluminum foil.

KE1=5 MeV per electron

ΔKE=KE1−KE2=4.3 MeV per electron (i.e. energy absorbed by object per electron)

I=10 mA

Figure 10:
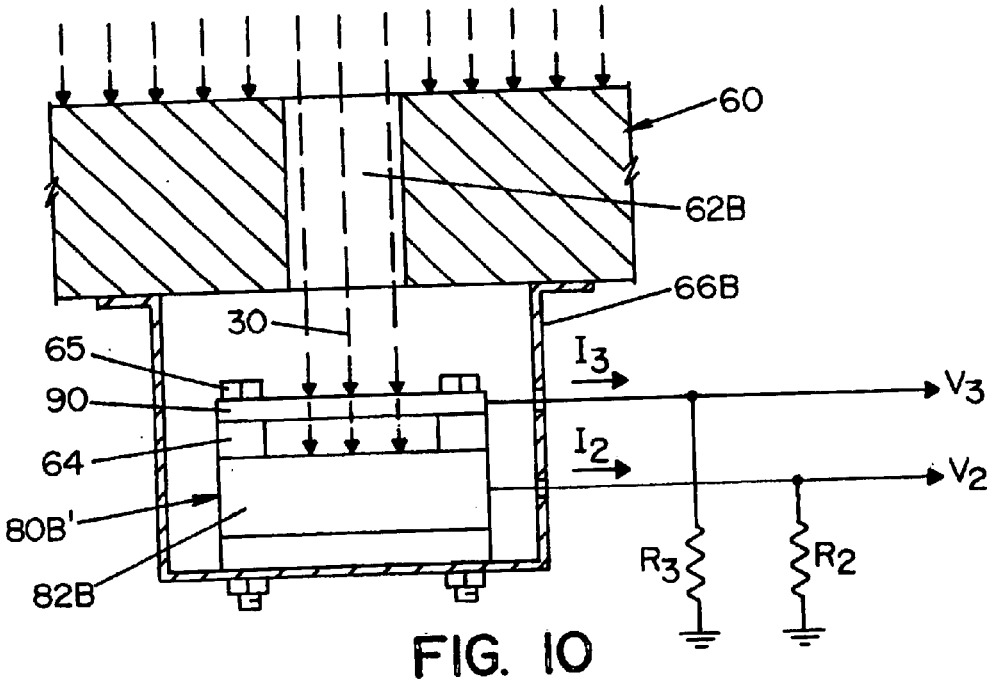
FIG. 10 is a sectional view of a collimator, and a second sensor according to an alternative embodiment.

Absorbed Dose $D = [(KE1 - KE2)(I)(T)]/m$ $= [(5\ \text{MeV} - 0.7\ \text{MeV})(10\ \text{mA})(2.5\ \text{msec})]/6\text{g}$ $= [(4.3\times10^6\text{eV})(10\times10^{-3}C/s)(2.5\times10^{-3}s)]/6\times10^{-3}\text{kg}$ $= [(4.3\times10^6\text{eV})(25\times10^{-6}C)]/6\times10^{-3}\text{kg}$ $= [(4.3\times10^6\text{eV})(25\times10^{-6}C)(6.24\times10^{18}\ \text{electrons}/C)]/6\times10^{-3}\text{kg}$ $= [(4.3\times10^6\text{eV})(1.56\times10^{14}\ \text{electrons})]/6\times10^{-3}\text{kg}$ $= [(6.708\times10^{20}\text{eV})(1.602\times10^{-19}J/\text{eV})]/6\times10^{-3}\text{kg}$ $= 17.91\times10^3 J/\text{kg} = 17.91\,kGray$ Referring now to FIG. 10, a sensor 80B' according to an alternative embodiment is shown. In this embodiment, a current $I_3$ of electrons in absorber plate 90 (produced by the collimated e-beam passing through absorber plate 90) is determined by measuring a voltage $V_3$ across a resistor $R_3$. As will be appreciated by those skilled in the art, current $I_1$ can be determined by summing $I_2$ and $I_3$. Consequently, sensor 80A does not need to be used in connection with alternative sensor 80B' in order to derive kinetic energy KE2 using the data tables expressing a relationship between $I_2/I_1$ and kinetic energy for a known absorber plate.

Figure 11:
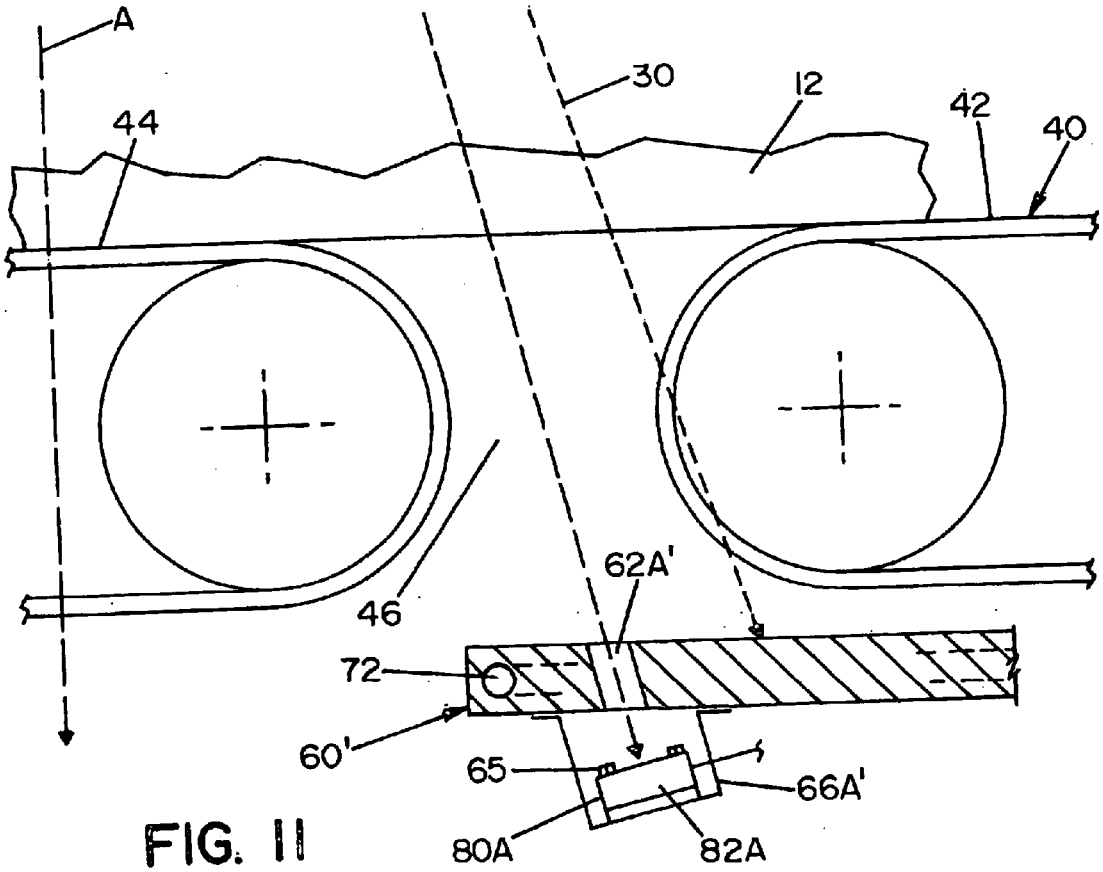
FIG. 11 is sectional view illustrating a collimator according to an alternative embodiment.

Referring now to FIG. 11, there is shown a collimator 60', according to an alternative embodiment. Collimator 60' includes a first aperture 62A' and a second aperture (not shown). Each aperture has a central axis that is angled relative to the longitudinal axis of collimator 60'. The apertures are angled to align their central axis with the direction of the e-beam passing through gap 46. A housing 66A' is dimensioned to align the central axis of sensors 80A with the central axis of first aperture 62A'. Likewise, a second housing is dimensioned to align the central axis of sensor 80B (not shown) with the central axis of the second aperture.

It should be appreciated that conveyor system 40 is shown solely for the purpose of illustrating a preferred embodiment, and not for limiting same. In this regard, conveyor system 40 may take other forms, including but not limited to an overhead conveyor, a pneumatic conveyor, a hydraulic conveyor, or the like.

Other modifications and alterations will occur to others upon their reading and understanding of the specification. For instance, it is contemplated that the present invention may be suitably modified to irradiate an entire object while the object remains stationary under the e-beam. Irradiation commences in response to a sensor indicating proper positioning of the object relative to the location of an e-beam. In calculations of dose D, the travel time ($T_t$) through the beam is substituted with the time the e-beam is on. It is intended that all such modifications and alterations be included insofar as they come within the scope of the invention as claimed or the equivalents thereof.

Having described the invention, the following is claimed:

1. An irradiation apparatus, comprising:

an e-beam source for providing an e-beam;

a conveyor system for conveying an object to be irradiated through the e-beam at a speed v, said conveyor system including an opening that allows a portion of the e-beam to pass through the object without striking the conveyor system;

a collimator locatable to isolate portions of the e-beam that have passed through the object and the opening, said collimator including at least first and second apertures for respectively providing first and second collimated e-beams; and first and second sensors for providing data indicative of the kinetic energy of the electrons absorbed by the object, said first sensor receiving the first collimated e-beam, and the second sensor receiving the second collimated e-beam.

2. An irradiation apparatus as defined by claim 1, wherein said first and second sensors provide data for calculating the number of electrons in the e-beam.

3. An irradiation apparatus as defined by claim 1, wherein said first and second sensors are in air at standard pressure.

4. An irradiation apparatus as defined by claim 1, wherein said collimator has a thickness sufficient to shield said first and second sensors from radiation associated with said e-beam.

5. An irradiation apparatus as defined in claim 1, wherein said first and second sensors respectively include a first electron collecting device and a second electron collecting device.

6. An irradiation apparatus as defined by claim 5, wherein said second sensor includes an absorber plate, said second collimated e-beam passing through the absorber plate before electron collection by said second electron collecting device.

7. An irradiation apparatus as defined by claim 6, wherein said first and second sensors respectively provide (a) first data to an associated processing system indicative of a first e-beam current, before the e-beam enters the absorber plate, and (b) second data indicative of a second e-beam current after the e-beam has passed through the absorber plate.

8. An irradiation apparatus as defined by claim 1, wherein said collimator includes cooling tubes for circulating coolant through said collimator.

9. An irradiation apparatus as defined by claim 1, wherein said apparatus further comprises a processing system for determining an absorbed dose for the object using the first and second data respectively provided by said first and second sensors.

10. An irradiation apparatus as defined in claim 6, wherein in accordance with the absorbed dose determined by the processing system said processing system modifies at least one of: the speed v of said conveyor system, energy of said e-beam, a current of said e-beam, and a scanning velocity of said e-beam.

11. An irradiation apparatus as defined in claim 1, wherein said apparatus includes first and second housings connected with the collimator, said first and second housings respectively housing said first and second sensors.

12. An irradiation apparatus as defined in claim 1, wherein said e-beam source scans said e-beam in at least one of:

a direction perpendicular to a direction of conveyance of the object, a direction parallel to a direction of conveyance of the object, and a direction at an angle to a direction of conveyance of the object.

13. An irradiation apparatus as defined in claim 12, wherein said e-beam source scans said e-beam through an arc of 30 degrees in a direction generally perpendicular to a direction of conveyance of said object.

14. An irradiation apparatus as defined in claim 1, wherein said e-beam is selected from the group consisting of: a pulsed e-beam, a direct current (DC) e-beam, a radio frequency continuous wave (RF CW) e-beam, and a radio frequency (RF) pulsed e-beam.

15. A method for irradiating an object, comprising:

accelerating electrons to provide an e-beam;

moving an object through the e-beam on a conveyor system, said object traveling at a speed v;

measuring a first current and a second current associated with the e-beam, after the e-beam has passed through the object, said first current and second current indicative of a kinetic energy absorbed by the object passing through the e-beam;

determining a number of electrons in the e-beam for a time of irradiation; and determining an absorbed dose D for a selected area of the object in accordance with the kinetic energy absorbed by the object passing through the e-beam.

16. A method as defined by claim 15, wherein said method further comprises:

comparing the absorbed dose D to a threshold value; and modifying at least one of: (1) a parameter of the e-beam source and (2) the speed v, in accordance with the comparison of the absorbed dose D to the threshold value.

17. A method as defined by claim 15, wherein said method further comprises:

displaying the absorbed dose D on an output device.

18. A method as defined by claim 15, wherein the step of determining an absorbed dose D for a unit mass of the object includes:

determining a beam scanning velocity of the e-beam;

determining an exposure time of the unit area per beam scan;

determining a travel time of the unit area through the e-beam;

determining a total number of beam scans during the travel time; and determining a total exposure time of the unit area to the e-beam.

19. A method as defined by claim 15, wherein at least one portion of said e-beam is collimated after passing through said object to form at least one collimated e-beam.

20. A method as defined by claim 15, wherein said first current is a current associated with the e-beam after passing through the object, and said second current is a current associated with the e-beam after passing through the object and an absorber plate having known absorption characteristics.

21. A method as defined by claim 15, wherein said first current is an e-beam induced current in an absorber plate having known absorption characteristics associated with the e-beam after it has passed through the object; and said second current is a current associated with the e-beam after passing through the object and the absorber plate.

22. An irradiation system, comprising:

radiation generating means for generating an e-beam of known energy;

conveyance means for conveying an object through said e-beam at a speed v;

a collimating means locatable to isolate portions of the e-beam after passing only through said object, said collimating means including at least first and second apertures for respectively providing first and second collimated e-beams;

sensing means for providing data indicative of a kinetic energy absorbed by the object, wherein said sensing means includes first and second sensors for providing data indicative of the kinetic energy of the electrons absorbed by the object, said first sensor receiving the first collimated e-beam, and the second sensor receiving the second collimated e-beam; and processing means for receiving said data and determining a value for absorbed dose D of the object.

23. An irradiation system as defined by claim 22, wherein said sensing means provide data for calculating a number of electrons in the e-beam.

24. An irradiation system as defined by claim 22 wherein said processing means further comprises:

modification means for modifying at least one of: (1) a parameter of the radiation generating means, and (2) the speed v, in accordance with the predetermined absorbed dose D.

25. An irradiation system as defined by claim 24, wherein said modification means compares the determined absorbed dose D to a predetermined threshold value.

26. An irradiation system as defined by claim 25, wherein said absorbed dose D is continuously monitored, and said processing means modifies at least one of: (1) a parameter of the radiation generating means, and (2) the speed v, throughout conveyance of the object Through the e-beam, in response to the comparison of the determined absorbed dose D to the predetermined threshold value.

27. A method for irradiating an object, comprising:

accelerating electrons to provide an e-beam;

moving an object through the e-beam on a conveyor system, said object traveling at a speed v;

measuring a first current and a second current associated with the e-beam, after the e-beam has passed only through the object, said first current and second current indicative of a kinetic energy absorbed by the object passing through the e-beam; and determining an absorbed dose D for a selected area of the object in accordance with the kinetic energy absorbed by the object passing through the e-beam.

28. A method as defined by claim 27 wherein said method includes determining a number of electrons in the e-beam for a time of irradiation.

29. A method as defined by claim 27, wherein said method further comprises:

comparing the absorbed dose D to a threshold value; and modifying at least one of: (1) a parameter of the e-beam source and (2) the speed v, in accordance with the comparison of the absorbed dose D to the threshold value.

30. A method as defined by claim 27, wherein said method further comprises: displaying the absorbed dose D on an output device.

31. A method as defined by claim 27, wherein the step of determining an absorbed dose D for a unit mass of the object includes:

determining a beam scanning velocity of the e-beam;

determining an exposure time of the unit area per beam scan;

determining a travel time of the unit area through the e-beam;

determining a total number of beam scans during the travel time; and determining a total exposure time of the unit area to the e-beam.

32. A method as defined by claim 31, wherein said method includes determining a number of electrons in the e-beam for a time of irradiation.

33. A method as defined by claim 27, wherein at least one portion of said e-beam is collimated after passing through said object to form at least one collimated e-beam.

34. A method as defined by claim 27, wherein said first current is a current associated with the e-beam after passing through the object, and said second current is a current associated with the e-beam after passing through the object and an absorber plate having known absorption characteristics.

35. A method as defined by claim 27, wherein said first current is an e-beam induced current in an absorber plate having known absorption characteristics associated with the e-beam after it has passed through the object; and said second current is a current associated with the e-beam after passing through the object and the absorber plate.

* * * * *